US008950160B1

(12) United States Patent
Ridings, III

(10) Patent No.: US 8,950,160 B1
(45) Date of Patent: Feb. 10, 2015

(54) MORTAR PACKAGES AND SINGLE-PERSON METHOD OF USING MORTAR PACKAGES FOR MASONRY CONSTRUCTION

(71) Applicant: Preferred Inspections, Inc.

(72) Inventor: Clayton L. Ridings, III, Wilmington, DE (US)

(73) Assignee: Preferred Inspections, Inc., Wilmington, DE (US)

( * ) Notice: Subject to any disclaimer, the term of this patent is extended or adjusted under 35 U.S.C. 154(b) by 0 days.

(21) Appl. No.: 14/158,019

(22) Filed: Jan. 17, 2014

(51) Int. Cl.
*E04B 1/00* (2006.01)
*E04B 2/28* (2006.01)
*B65D 25/34* (2006.01)

(52) U.S. Cl.
CPC .. *E04B 2/28* (2013.01); *B65D 25/34* (2013.01)
USPC ..... 52/747.12; 52/612; 425/18; 425/284; 383/32

(58) Field of Classification Search
CPC ..... E02B 3/127; E02B 3/04
USPC ..... 52/742.14, 747.1, 169.9, 294, 608, 52/742.13, 742.16, 747.12, 612; 53/434, 53/447, 526; 383/105, 32; 405/15, 18, 284
See application file for complete search history.

(56) References Cited

U.S. PATENT DOCUMENTS 2,784,131 A * 3/1957 Fletcher, Jr. ..... 206/503
2,917,223 A * 12/1959 Le Bolt et al. ..... 383/32
3,283,992 A * 11/1966 Hanson et al. ..... 383/32
3,374,635 A * 3/1968 Crandall ..... 405/18
3,425,228 A * 2/1969 Lamberton ..... 405/18
3,438,207 A * 4/1969 Turzillo ..... 405/287
3,474,626 A * 10/1969 Colle ..... 405/18
3,670,504 A * 6/1972 Hayes et al. ..... 405/32
3,786,640 A * 1/1974 Turzillo ..... 405/18
3,886,751 A * 6/1975 Porraz Jimenez Labora 405/107
3,890,802 A * 6/1975 Auriat et al. ..... 405/117
3,922,832 A * 12/1975 Dicker ..... 52/741.15
4,061,825 A * 12/1977 Counsell et al. ..... 428/355 CP
4,449,847 A * 5/1984 Scales et al. ..... 405/19
4,486,121 A * 12/1984 Thompson et al. ..... 405/17
4,502,815 A * 3/1985 Scales et al. ..... 405/17
4,690,585 A * 9/1987 Holmberg ..... 405/19
4,919,567 A * 4/1990 Sample ..... 405/19
5,158,395 A * 10/1992 Holmberg ..... 405/21
5,584,599 A * 12/1996 Knittel ..... 405/15
5,934,027 A * 8/1999 Khalili ..... 52/167.1
6,132,780 A * 10/2000 Archibald et al. ..... 426/106
6,378,272 B1 * 4/2002 Archibald et al. ..... 53/412

(Continued)

*Primary Examiner* — James Ference
(74) *Attorney, Agent, or Firm* — Panitch Schwarze Belisario & Nadel LLP

(57) ABSTRACT

Pre-filled mortar packages are positioned between masonry construction elements (such as stones, blocks or bricks) when forming a wall (such as a dry-stack stone wall). Each mortar package includes an outer covering with a porous outer surface, a mortar mixture covered by the outer covering, and (optionally) an adhesive incorporated onto or in the porous outer surface. Both the adhesive and the mortar mixture are activated by a liquid, such as water. The mortar packages may be pre-wetted and placed on masonry construction elements when stacking the masonry construction elements. Alternatively, the mortar packages may be dry when placed on masonry construction elements, and activated by applying water or by wetting from rain water. Mortar packages are more convenient and efficient than adhesives or mortar alone, and create walls and other structures with increased strength and improved aesthetics.

10 Claims, 5 Drawing Sheets

(56) References Cited

U.S. PATENT DOCUMENTS

| | | | | |
|---|---|---|---|---|
| 6,471,402 | B1 * | 10/2002 | Burns | 383/32 |
| 6,491,431 | B2 * | 12/2002 | Merten | 383/32 |
| 6,944,998 | B1 * | 9/2005 | King | 52/314 |
| 7,083,364 | B2 * | 8/2006 | Kim | 405/284 |
| 7,214,002 | B2 * | 5/2007 | Laine | 405/53 |
| 7,452,164 | B2 * | 11/2008 | Kim | 405/284 |
| 7,677,841 | B2 * | 3/2010 | Shin et al. | 405/284 |
| 7,765,774 | B2 * | 8/2010 | Mandzsu et al. | 53/434 |
| 8,196,370 | B2 * | 6/2012 | Scheckler | 52/747.1 |
| 8,235,631 | B2 * | 8/2012 | Adams et al. | 405/284 |
| 8,371,772 | B2 * | 2/2013 | Chang | 405/284 |
| 8,602,692 | B2 * | 12/2013 | Adams et al. | 405/284 |
| 2002/0090265 | A1 * | 7/2002 | Merten | 405/18 |
| 2002/0100241 | A1 * | 8/2002 | Rygiel | 52/561 |
| 2005/0011144 | A1 * | 1/2005 | Laine | 52/169.7 |
| 2007/0196176 | A1 * | 8/2007 | Laine | 405/53 |
| 2008/0016825 | A1 * | 1/2008 | Mandzsu et al. | 53/411 |
| 2008/0101862 | A1 * | 5/2008 | Mountain | 405/18 |
| 2008/0247685 | A1 * | 10/2008 | Kim | 383/113 |
| 2009/0304458 | A1 * | 12/2009 | Chang | 405/284 |
| 2010/0170960 | A1 * | 7/2010 | Barnhill | 239/17 |
| 2010/0254636 | A1 * | 10/2010 | Elkhouli | 383/102 |
| 2010/0293849 | A1 * | 11/2010 | Chang | 47/66.6 |
| 2011/0103900 | A1 * | 5/2011 | Adams et al. | 405/284 |
| 2012/0117739 | A1 * | 5/2012 | Cook | 14/73 |
| 2012/0180435 | A1 * | 7/2012 | Stelluti | 53/469 |
| 2012/0195695 | A1 * | 8/2012 | Adams et al. | 405/284 |
| 2012/0238163 | A1 * | 9/2012 | Scherer | 442/3 |
| 2012/0261278 | A1 * | 10/2012 | Mandzsu et al. | 206/213.1 |

* cited by examiner

MORTAR PACKAGES AND SINGLE-PERSON METHOD OF USING MORTAR PACKAGES FOR MASONRY CONSTRUCTION

BACKGROUND OF THE INVENTION

1. Field of the Invention

The field of the present invention is mortar packages and methods of using mortar packages, particularly for masonry construction.

2. Background

Masonry elements, such as stone walls, serve many practical purposes and can add value to a property. For example, when stones or bricks are used to form a retaining wall, a property owner can change the landscape of a sloping yard into one that is more functional. Walls can serve as demarcation lines that define the boundaries of a property. In addition, walls may improve aesthetics or visual interest of a property.

Dry stacking is one method of building a stone wall. A dry-stacked retaining wall is built by vertically stacking stones of various width, length, and thickness. As the stones are stacked, crevices between the stones are filled with sand, gravel, and smaller stones. Gravity and friction hold the stones together, usually without any type of mortar or adhesive or additional reinforcement. Stacking stones is labor intensive. As a wall is built, smaller rocks typically are broken off from larger stones and shaped to fit in gaps in the wall for leveling purposes.

Over time, however, the stones used to build dry-stacked walls shift from their initial positions. This shifting is worsened by weather effects (e.g., rain, snow, wind) and other stressors that loosen the sand, gravel, and small stones positioned in crevices in the dry stacked wall. Although some open crevices are acceptable for water drainage purposes, these crevices will eventually enlarge and adversely affect the structural integrity of the wall.

To deter the shifting and movement of stones many professional contractors reinforce the interior of walls with mortar. Using mortar only on surfaces of stones that are placed within interior portions of the wall can preserve the exterior look of a dry-stacked stone wall. Unfortunately, applying mortar to the interior of the wall is at least a two-person or more person job. In the case of two persons or more, one person continuously mixes and prepares mortar slurry for application, while at least one other person stacks stones to form the wall and applies the mortar as it is needed.

Conventional methods of dry stacking and reinforcing masonry walls can be improved upon. Dry-stacked stone walls will at some point require reinforcement because of the shifting and movement of stones. But the methods of addressing these problems require at least two people and are labor intensive. For these reasons, among others, there is a clear need for improved masonry construction methods. The present invention fulfills this need and provides further related advantages, as described in the following summary.

SUMMARY OF THE INVENTION

The present invention is directed towards mortar packages and methods of using mortar packages for masonry construction. Instead of conventionally stacking stones to form dry-stacked stone walls and reinforcing these walls with sand, gravel, small stones, and/or concrete, mortar packages are positioned between masonry construction elements. Mortar packages may be shaped or compressed when installed to better level and stablize wall surfaces.

A mortar package includes an outer covering, having a porous outer surface. Incorporated into or on the porous outer surface is an adhesive. A mortar mixture, which is preferably dry, is held within and covered by the outer covering. Both the adhesive and the mortar mixture preferably are activated by a liquid (e.g. water), where the term "activated" is defined herein as the setting of product constituents for bonding purposes.

A more complete understanding of various configurations of the mortar packages and single-person methods of using mortar packages will be afforded to those skilled in the art, as well as a realization of additional advantages and objects thereof, by consideration of the following detailed description. Reference will be made to the appended sheets which will first be described briefly.

BRIEF DESCRIPTION OF THE DRAWINGS

The drawings described herein are for illustrative purposes only and not intended to limit the scope of the present disclosure. Like element numerals may be used to indicate like elements appearing in one or more of the figures.

DETAILED DESCRIPTION

Figure 2:
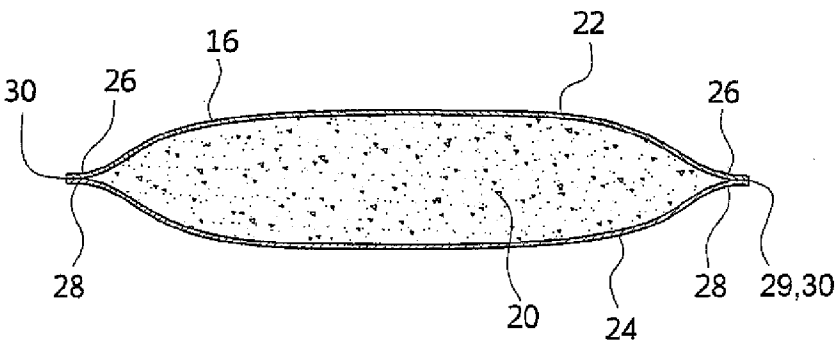
FIG. 2 shows a cross-sectional view of the mortar package shown in FIG. 1 taken along line 2-2 of FIG. 1.
Figure 1:
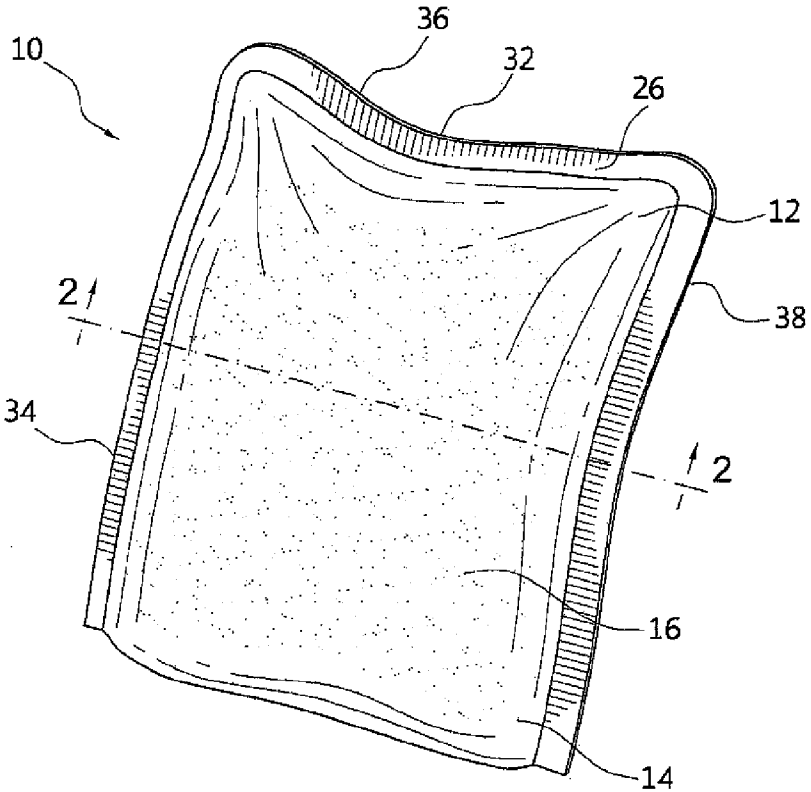
FIG. 1 shows one configuration of mortar package.

Turning in detail to the drawings, FIG. 1 shows one configuration of a mortar package 10, which is generally pillow-shaped. These types of mortar packages are particularly useful for masonry construction. The term "masonry," however, should be broadly construed to relate to the building of structures from individual units, such as stones, blocks, and bricks, which are laid in one or more substantially linear formations. A mortar package includes an outer covering 12, having a porous outer surface 14 and an adhesive 16 incorporated into at least a portion of the porous outer surface. The outer covering 12 covers a mortar mixture 20, as shown in FIG. 2.

The outer covering 12 may have various configurations. For example, as shown in FIG. 2, the outer covering 12 can include an upper sheet 22 and a lower sheet 24. Both sheets have edges 26, 28 that may be joined together in various manners, such as bonded or seamed with an edge sealant 29 or attachment element 30 around a covering perimeter 32. The covering perimeter 32 extends along at least three sides 34, 36, 38 of the mortar package 10. Alternatively, the outer covering may be a continuous sheet of material, such that the covering forms a pouch or envelope, having an opening, which may be joined or sealed after a mortar mixture is inserted into or dispensed within the covering.

Each type of outer covering configuration includes a porous outer surface 14, optionally having an adhesive 16 incorporated therein or applied thereon. The outer covering may, for example, be manufactured from one or more woven fiber-based fabrics. Preferably, the material is biodegradable, such that it disintegrates over time without negative environmental consequences.

Burlap is one type of fiber-based fabric material that may be used for the outer covering. It is eco-friendly, porous and biodegradable. The adhesive 16 may be incorporated in or on the outer surface. The porous outer surface 14 has sufficient porosity such that a wetting or activation liquid, such as water, may penetrate through the outer surface and into the interior of the mortar package.

The adhesive 16, which optionally is incorporated into the outer surface 14, is liquid-activated (preferably water-activated) and capable of bonding to stone, block and brick materials. The adhesive provides an additional way to reinforce a masonry structure, beyond the use of adhesives and mortar mixtures used alone. Adhesive types include, but are not limited to adhesives that are resin-based and water-based or water-soluble. Representative adhesives include moisture curing adhesives such as cyanoacrylates, urethanes, rubber cements, glues or polyvinyl acetate dispersions, and pressure sensitive adhesives such as acrylate based polymers. Bioadhesives also may be used. One suitable adhesive is High Tack Fish Glue (CAS#9000-70-8) from Norland Products, Inc. of Cranbury, N.J.

Figure 4:
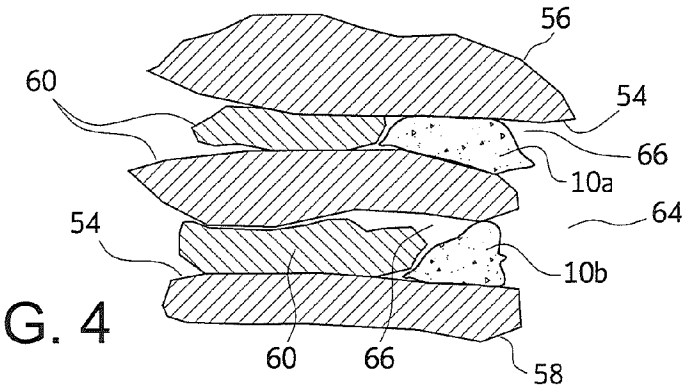
FIG. 4 shows a cross-sectional view of the stone wall shown in FIG. 3 taken along line 4-4 of FIG. 3.
Figure 6:
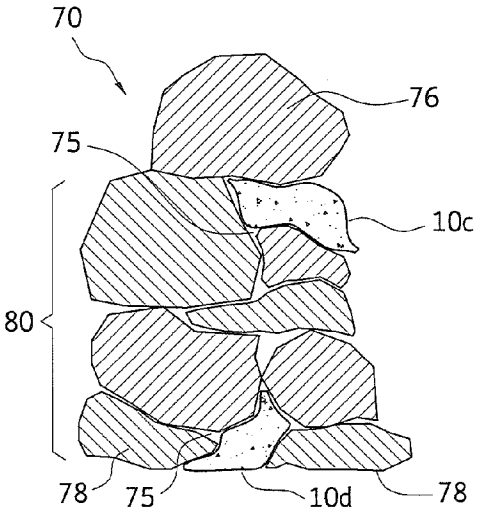
FIG. 6 shows a cross-sectional view of the stone wall shown in FIG. 6 taken along line 6-6 of FIG. 5.

A mortar mixture 20 is held or disposed within the inner volume defined by the outer covering 12, and is covered by the outer covering 12, as particularly shown in FIGS. 2, 4, and 6. The mortar mixture 20 may be any type of mixture suitably used for building and bonding masonry structures. Such mortar mixtures traditionally include cement (e.g., Portland cement), lime, and an aggregate, such as sand. The mixtures are preferably dry, pre-mixed, powdered mixtures, which are activated by liquid, usually water. The mortar mixture 20 has a density and powder particle size range that allows the package 10 to be pliable, such that it can fit between masonry construction elements 40 of various sizes and shapes. Mortar mixes can be characterized by strength as follows: Type N is a medium strength mortar most often used for non-loadbearing brick walls and soft stone masonry; Type S is a higher strength mortar known for its ability to absorb most impacts, and can be used for patios, foundations and retaining walls; and Type M is a high strength mortar most often used with retaining walls and stone structures because it can bear heavier loads. Any of these mortar mixes is appropriately used with the present invention.

Figure 3:
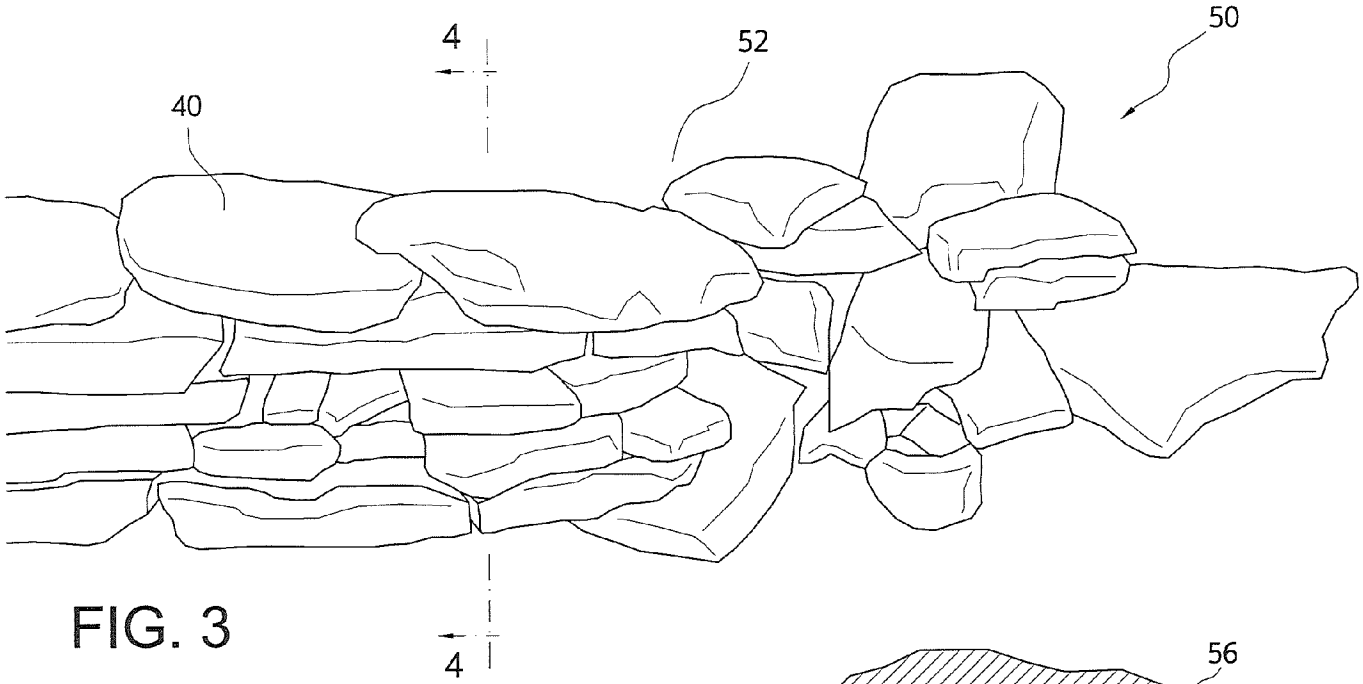
FIG. 3 shows a one type of stacked stone wall, including mortar packages disclosed herein.

FIGS. 3 and 4 show one type of stone wall 50, which includes masonry construction elements 40 of various sizes and shapes, and mortar packages 10*a*, 10*b* installed at locations between some of the masonry construction elements 40. This type of wall includes a plurality of stones 52 with some stones having at least one substantially flat surface 54. These types of stones are typically used for dry-stacking walls.

The cross-sectional view of the wall shown in FIG. 4 includes a cap stone 56 positioned on the top of the wall, a set stone 58 positioned on the bottom of the wall, and intermediate stones 60 positioned between the cap stone 56 and the set stone 58. Mortar packages 10*a*, 10*b* are positioned in crevices or openings 66 between adjacent stones in the wall to provide reinforcement at an interior section 64 of the wall. The mortar packages 10*a*, 10*b* are used to reinforce and level the wall 50.

Figure 5:
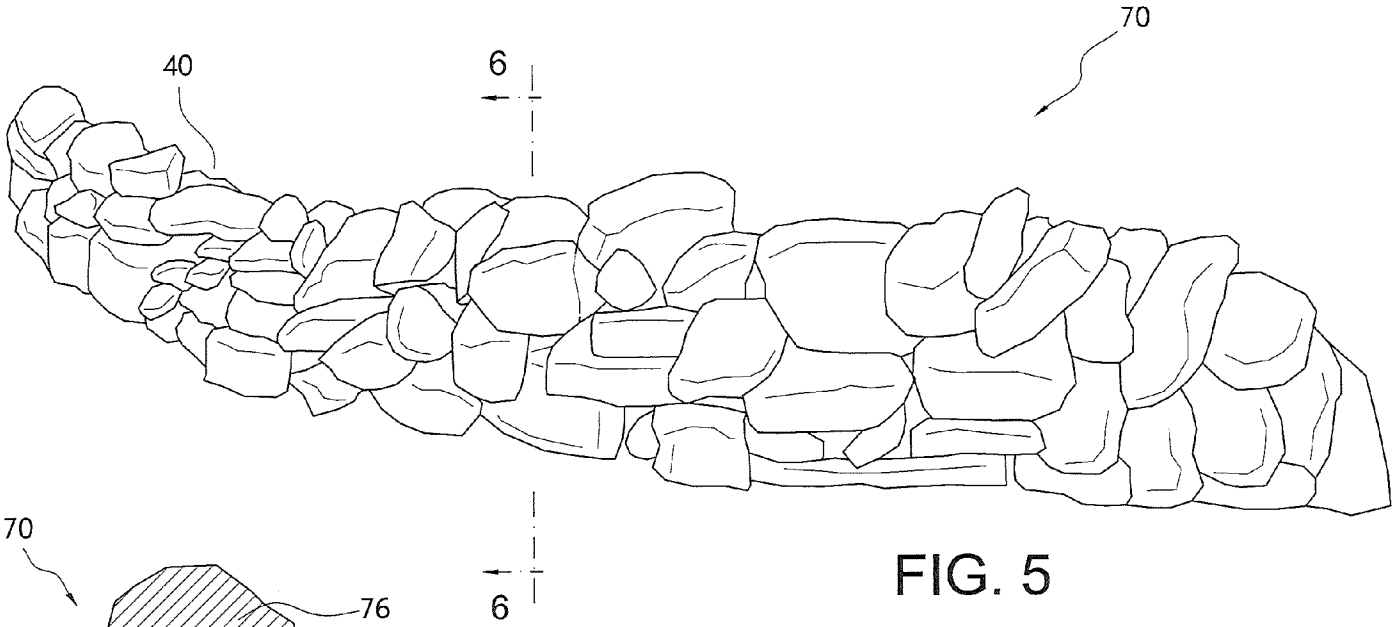
FIG. 5 shows another type of stacked stone wall, including the mortar packages disclosed herein.

FIGS. 5 and 6 show another type of stone wall 70, which includes masonry construction elements 40 of various sizes and shapes and mortar packages 10*c*, 10*d*. This type of wall includes a plurality of stones 72 with stones having irregularly shaped surfaces 74. These types of stones are typically not used for dry-stacking. Due to the compliant nature of the mortar packages 10*c*, 10*d*, a wall which is structurally sound may be built by stacking the stones and positioning the mortar packages between some of the stones.

The cross-sectional view of the wall shown in FIG. 6 includes a cap stone 76 positioned on the top of the wall, set stones 78 positioned on the bottom of the wall, and intermediate stones 80 positioned between the cap stone 76 and set stones 78. Mortar packages 10*c*, 10*d* are positioned in crevices or openings 75 between adjacent stones in the wall 70 to provide reinforcement at an interior section 75 of the wall. The mortar packages 10*c*, 10*d* are used to reinforce and provide structural integrity to the wall 70.

Figure 7:
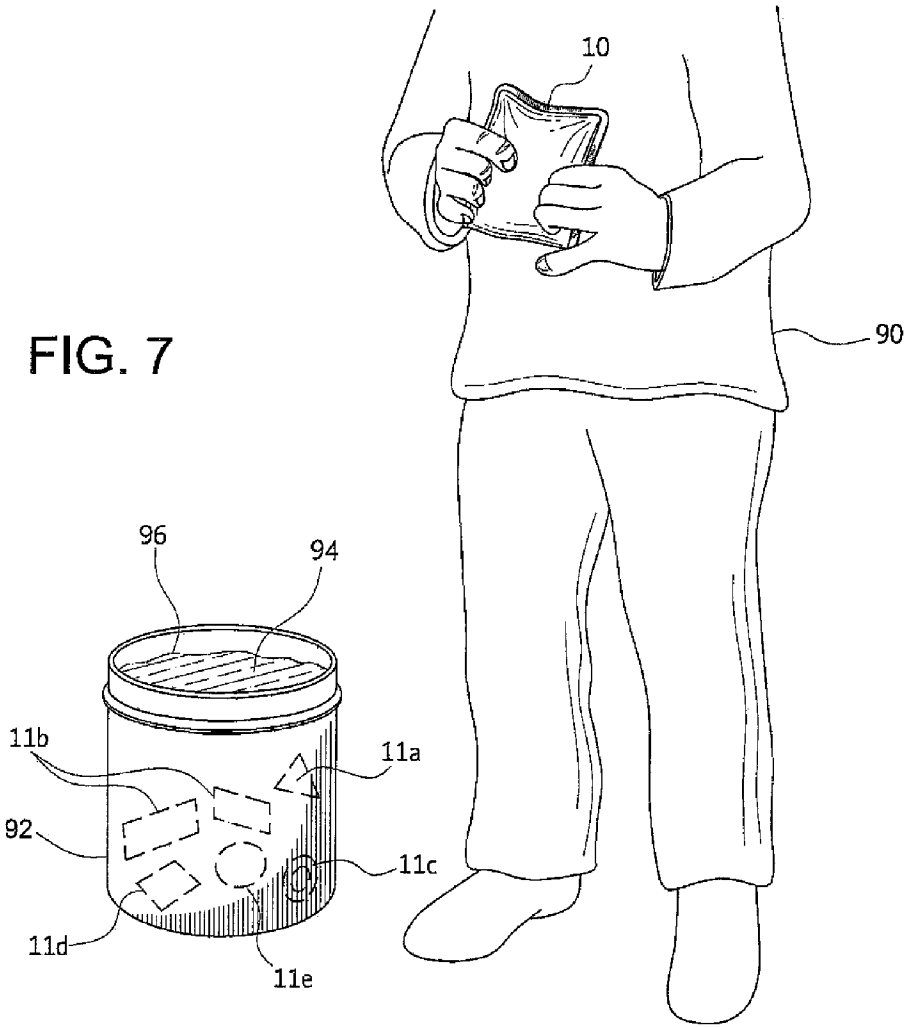
FIG. 7 shows a person holding an exemplary mortar package, and a bucket container filled with an activation liquid and having mortar packages of various sizes and shapes soaking in such activation liquid.

FIG. 7 shows mortar packages 11*a*, 11*b*, 11*c*, 11*d*, 11*e* of various shapes and sizes. The alternative shaped and sized mortar packages allow a user 90 to hand select different types of mortar packages to position in wall crevices or openings while constructing the wall. Shapes of mortar packages include, but are not limited to tubular-shaped mortar packages, triangular-shaped mortar packages 11*a*, oblong or rectangular-shaped mortar packages 11*b*, donut-shaped mortar packages 11*c*, rectangular or square-shaped mortar packages 11*d*, and oval, round or circular-shaped mortar packages 11*e*. Mortar packages may have varied length (or diameter), width and thickness as desired. One example of a mortar package is a square-shaped mortar package 11*d*, having a length and width of about 2 to 8 inches, and a thickness of about 1 to 4 inches, preferably about 1 to 2 inches. The mortar packages of the invention may have dimensions anywhere from 2 inch by 2 inch square, to 2 foot by 2 foot square, or up to 2 foot in diameter for round or oval shapes.

FIG. 7 also shows how both the optional adhesive 16 and the mortar mixture 20 can be activated by pre-soaking. A user 90 may activate the adhesive 16 and mortar mixture 20 by soaking mortar packages 10 in a bucket or container 92 with an activation liquid 94, such as water 96 therein. Alternatively, the activation liquid 94 may be applied to the mortar package by wetting mortar packages after they are positioned in a wall. Wetting may occur by hosing down the wall or dousing interior sections of the wall that include the mortar packages with water. As still another alternative, a user may allow a soaking rainfall to wet the wall and thereby indirectly wet the mortar packages to activate the adhesive and mortar mixture.

Together, the optional adhesive 16 and the mortar mixture 20 of the mortar packages bond masonry construction elements 40 to one another. There is advantage to the combination of adhesive 16 and mortar mixture 20 where an adhesive may be selected to more rapidly set and secure the mortar package to the masonry elements, giving time for the mortar mixture to cure. As such, mortar packages 10, 11 may be used to form walls with increased strength, compared to those which use adhesives or mortar alone. These walls are also less susceptible to weather damage and more resistant to other damage.

The mortar packages 10, 11 when installed may act as a balancer or anti-rock dampener to keep the masonry construction elements 40, particularly those with irregular surfaces such as stones, from rocking or working loose from the wall or other masonry structure.

Figure 8:
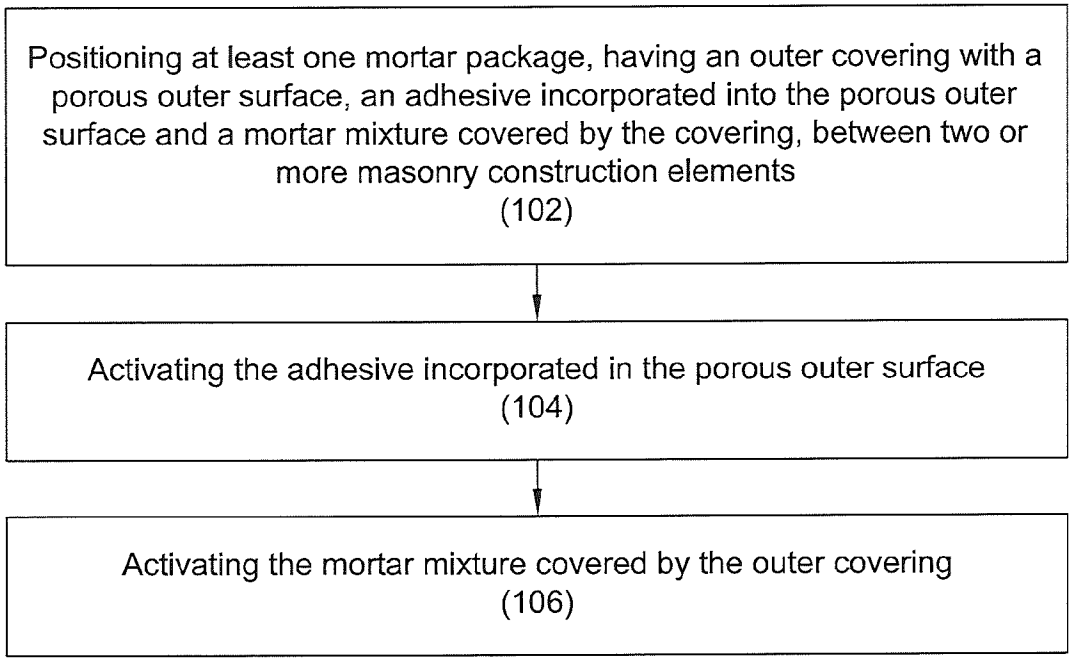
FIG. 8 outlines steps in a single-person method of using mortar packages for masonry construction.

FIG. 8 shows a series of steps for a single-person method 100 of using the mortar packages, described herein, for masonry construction. These steps include:

Positioning at least one mortar package, having an outer covering with a porous outer surface, an adhesive incorporated into the porous outer surface and a mortar mixture covered by the covering, between two or more masonry construction elements 102;

Activating the adhesive incorporated in or on the porous outer surface 104; and Activating the mortar mixture covered by the outer covering 106.

While embodiments of this invention have been shown and described, it will be apparent to those skilled in the art that many more modifications are possible without departing from the inventive concepts herein. The invention, therefore, is not to be restricted except in the spirit of the following claims.

The invention claimed is:

1. A method of forming a stacked masonry construction, comprising:

positioning two or more stones, blocks or bricks in a first level of the stacked masonry construction;

stacking two or more other stones, blocks or bricks over the first level to form a second level of the stacked masonry construction; and positioning at least one mortar package between at least one of the two or more stones, blocks or bricks of the first level and one of the two or more stones, blocks or bricks of the second level, wherein the mortar package has an outer covering with a porous outer surface, a mortar mixture covered by the outer covering, and an adhesive incorporated into or on the porous outer surface.

2. The method of claim 1, further comprising activating the adhesive incorporated in or on the porous outer surface.

3. The method of claim 2, further comprising activating the adhesive by wetting.

4. The method of claim 1, further comprising activating the mortar mixture covered by the outer covering.

5. The method of claim 1, further comprising activating the adhesive and the mortar mixture by wetting.

6. The method of claim 1, further comprising simultaneously activating the adhesive and the mortar mixture by soaking the mortar package in water.

7. The method of claim 1, further comprising positioning a second mortar package between the stones, blocks or bricks of the first level or the other stones, blocks, or bricks of the second level.

8. A method for making a dry-stack stone wall, comprising:

positioning two or more stones in a first level of the dry-stack stone wall;

stacking two or more other stones over the first level to form a second level of the dry-stack stone wall; and positioning at least one mortar package between at least two of the two or more stones of the first level and the two or more other stones of the second level, without applying mortar or adhesive onto the mortar package, wherein the mortar package has an outer covering with a porous outer surface, a mortar mixture covered by the outer covering, and a package adhesive incorporated in the porous outer surface of the mortar package.

9. The method of claim 8, further comprising simultaneously activating the package adhesive and the mortar mixture by pre-soaking the mortar package in water.

10. The method of claim 8, further comprising positioning a second mortar package between at least two of the two or more stones of the first level or the two or more other stones of the second level.

* * * * *